US009520660B2

(12) United States Patent
Chen et al.

(10) Patent No.: US 9,520,660 B2
(45) Date of Patent: Dec. 13, 2016

(54) SOCKET DEVICE AND PRINTED CIRCUIT BOARD ASSEMBLY

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Ching-Jou Chen, New Taipei (TW); Shen-Fa Tsai, New Taipei (TW); Jie Li, Wuhan (CN); Jin-Cai Gao, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/616,158

(22) Filed: Feb. 6, 2015

(65) Prior Publication Data

US 2016/0172772 A1 Jun. 16, 2016

(30) Foreign Application Priority Data

Dec. 12, 2014 (CN) ..... 2014 1 0760746

(51) Int. Cl.

| | |
|---|---|
| ***H01R 13/62*** | (2006.01) |
| ***H01R 12/70*** | (2011.01) |
| ***H01R 12/73*** | (2011.01) |

(52) U.S. Cl.

CPC ..... *H01R 12/7076* (2013.01); *H01R 12/7029* (2013.01); *H01R 12/737* (2013.01)

(58) Field of Classification Search

CPC ..... H01R 12/721; H01R 13/6275

USPC ..... 439/328, 325, 327

See application file for complete search history.

(56) References Cited

U.S. PATENT DOCUMENTS

| | | | | |
|---|---|---|---|---|
| 4,995,825 A * | 2/1991 | Korsunsky | H01R 12/83 | 439/326 |
| 5,112,242 A * | 5/1992 | Choy | H01R 12/7005 | 439/326 |
| 5,389,000 A * | 2/1995 | DiViesti | H01R 12/7005 | 439/157 |
| 8,657,612 B2 * | 2/2014 | Lu | H01R 12/7011 | 439/160 |

* cited by examiner

*Primary Examiner* — Phuong Dinh

(74) *Attorney, Agent, or Firm* — Zhigang Ma

(57) ABSTRACT

A socket device includes a socket mounted on a circuit board and an engaging member mounted to the socket. The socket defines a sliding groove. The engaging member includes a sliding piece engaged in the sliding groove. The sliding piece can slide along the slot to detach the engaging member from the socket. A chip may be mounted below the engaging member which member may be moved away from the socket to enable user to check the chip.

15 Claims, 5 Drawing Sheets

SOCKET DEVICE AND PRINTED CIRCUIT BOARD ASSEMBLY

CROSS-REFERENCE TO RELATED APPLICATIONS

This application claims priority to Chinese Patent Application No. 201410760746.2 filed on Dec. 12, 2014, the contents of which are hereby incorporated by reference.

FIELD

The subject matter herein generally relates to a socket device, and more particularly to a detachable socket device.

BACKGROUND

An electronic device includes a circuit board. Socket devices are attached to the circuit board to engage with cards, such as video cards and memory cards. Each socket devices generally include a socket configured to be inserted a card and an engaging member integrated with the socket. The engaging member is engageable with the card to avoid the card to detach from the socket, and a chip is located under the engaging member.

BRIEF DESCRIPTION OF THE DRAWINGS

Implementations of the present technology will now be described, by way of example only, with reference to the attached figures.

DETAILED DESCRIPTION

Figure 1:
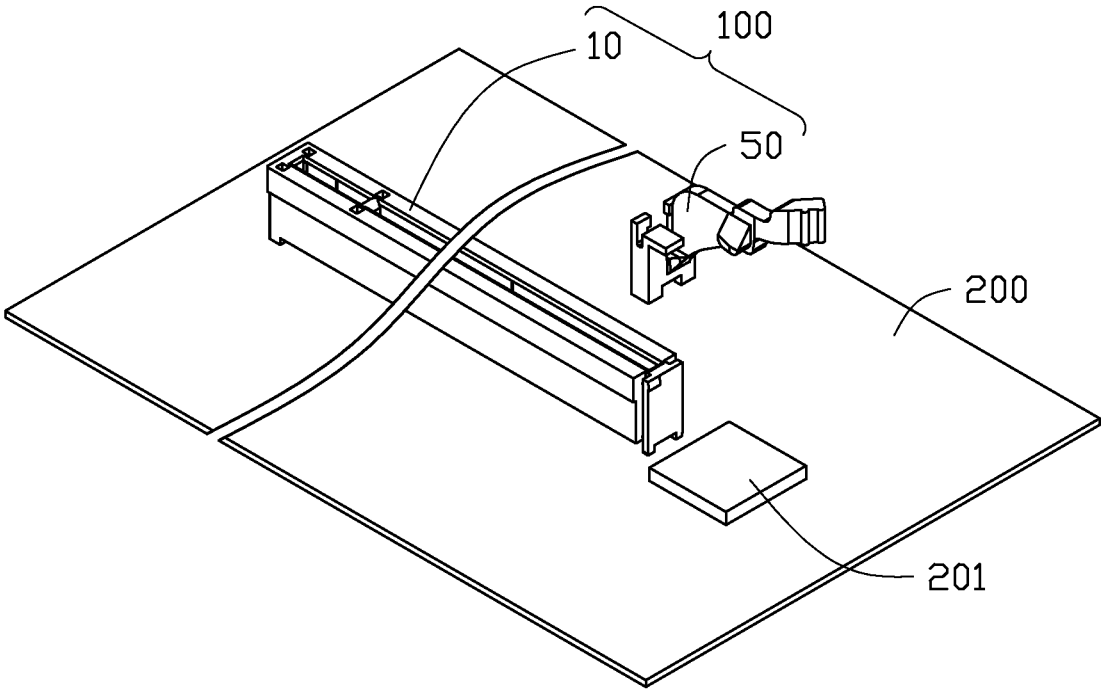
FIG. 1 is an exploded, isometric view of a socket device and a circuit board in accordance with an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates an embodiment of a printed circuit board (PCB) assembly including a socket device 100 and a circuit board 200. The socket device 100 can include an engaging member 50 and a socket 10 mounted on the circuit board 200. The circuit board 200 can include a chip 201. In at least one embodiment, the socket device 100 can be engaged with a card, such as a video card, a memory card and so on.

Figure 2:
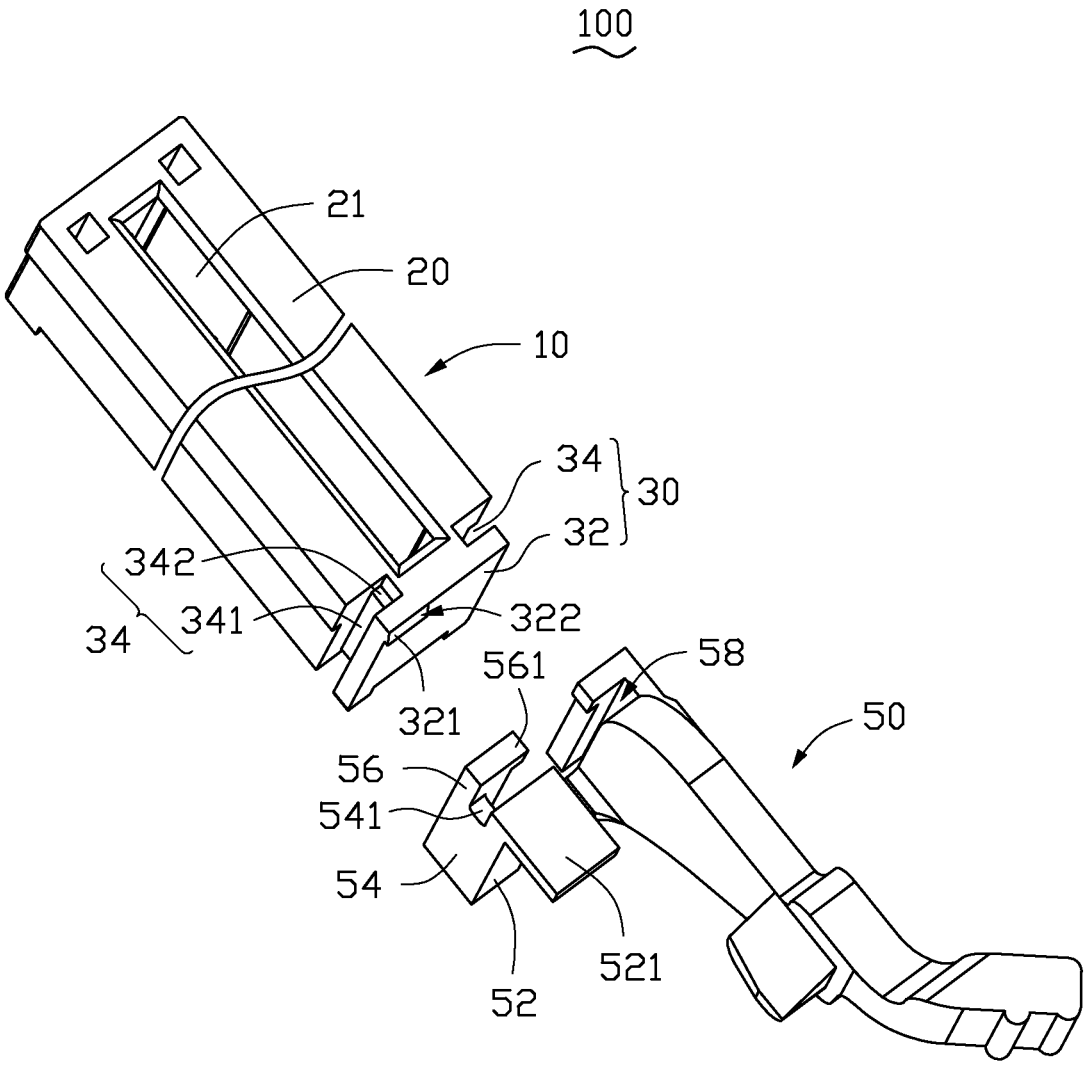
FIG. 2 is an exploded, isometric view of the socket device of FIG. 1.
Figure 3:
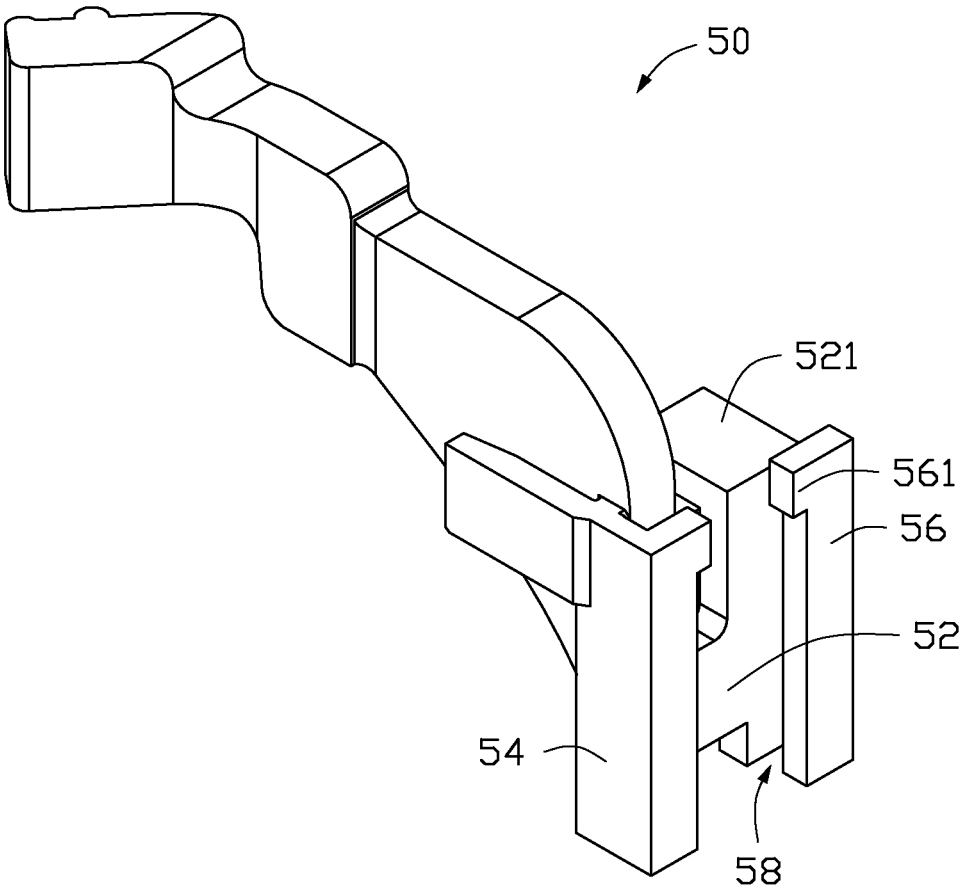
FIG. 3 is an isometric view of an engaging member of FIG. 2.

FIG. 2 and FIG. 3 illustrate the socket 10 including a main body 20 and a engaging portion 30 connected to the main body 20. The main body 20 defines a slot 21 configured to be engaged with the card.

The engaging portion defines two sliding grooves 34 located at two opposite sides of the slot 21. The engaging portion further includes a mounting plate 32. The sliding grooves 34 are located between the mounting plate 32 and the main body 20. A clamping block 321 extends from a side of the mounting plate 32 away from the sliding groove 34. The clamping block 321 has a guiding surface 322 configured to guide the engaging member 50 to slide to the socket 10. In at least one embodiment, the guiding surface 322 is an inclined plane extending to a top end of the mounting plate 32. The sliding groove 34 has an inner sidewall 341 adjacent to the slot 21. The inner sidewall 341 defines a limiting slot 342 extending to a top surface of the engaging member 30, thereby forming a step structure in the inner sidewall 341. An extending direction of the sliding groove 34 is substantially perpendicular to the circuit board 200.

The engaging member 50 can include a base plate 52, two connecting pieces 54 extending from two opposite sides of the base plate 52, and two sliding pieces 56 parallel with the base plate 52. Each sliding piece 56 is connected to the base plate 52 with one connecting piece 54. The connecting pieces 54 are substantially perpendicular to the base plate 52 and the sliding piece 56. In at least one embodiment, the two sliding pieces 56 are located on a same plane. A receiving space 58 configured to receive the mounting plate 32 is cooperatively defined by the base plate 52, the connecting piece 54, and the sliding piece 56. In at least one embodiment, a thickness of the sliding piece 56 is equal to a width of the sliding groove 34.

A pressing portion 521 extends substantially perpendicularly from the base plate 52. A notch 541 is defined in the connecting piece 54 and extends to the pressing portion 521, thereby convenient for an elastic deformation of the base plate 52. Each sliding piece 56 extends from a limiting piece 561. The two sliding pieces 56 are symmetrical.

Figure 4:
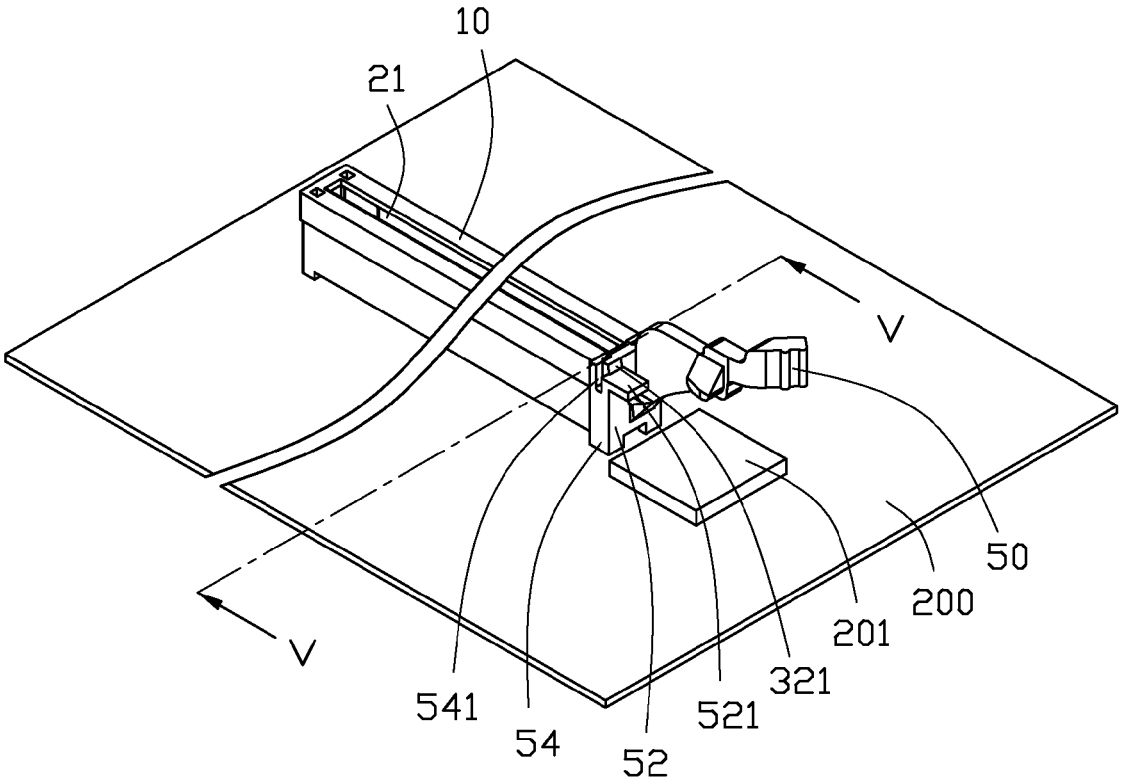
FIG. 4 is an assembled, isometric view of the socket device and the circuit board of FIG. 1.
Figure 5:
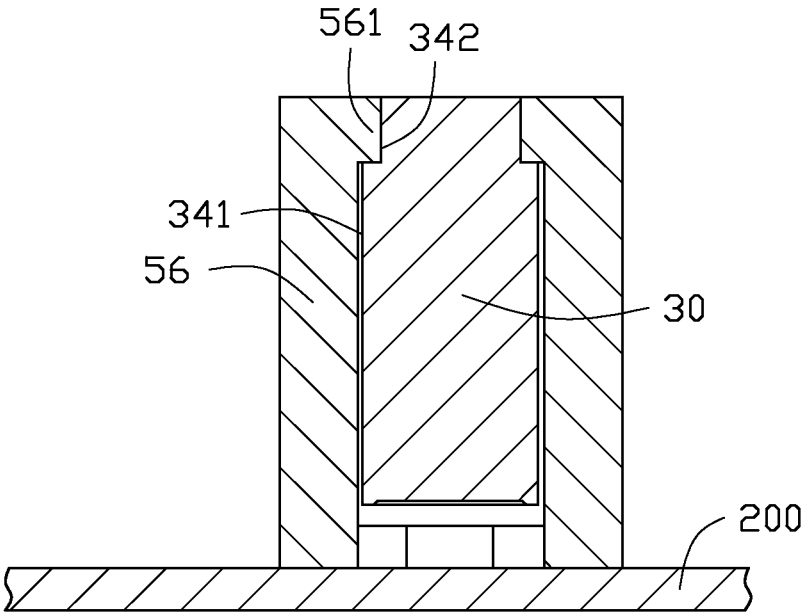
FIG. 5 is a cross-sectional view of FIG. 4, taken along a line V-V.

FIG. 4 and FIG. 5 are an assembly of the socket device 100 and the circuit board 200. The engaging member 50 is moved towards the socket 10 till the sliding piece 56 is received in the sliding groove 34. The engaging member 50 slides along the sliding groove 34 till the clamping block 321 abuts against the pressing portion 521. The mounting plate 32 is received in the receiving space 58. The pressing portion 521 is pressed to be mounted to the socket 10. The chip 201 is below the engaging member 50. So when the chip 201 is wrong and needs to be checked or repaired, the engaging portion 50 should be moved away.

In disassembly, the pressing portion 521 is pressed to elastically deform the base plate 52 to detach the pressing portion 521 from the clamping block 321, such that the engaging member 50 can move freely relative to the socket 10. The engaging member 50 can be moved away from the socket 10, thereby users can conveniently check and repair the chip 201.

The embodiments shown and described above are only examples. Many details are often found in the art such as the other features of a socket device and a PCB assembly. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A socket device comprising:

a socket mounted on a circuit board and defining a sliding groove; and an engaging member mounted to the socket and comprising a sliding piece engaged in the sliding groove;

wherein the sliding piece is slidable along the sliding groove to detach the engaging member from the socket;

wherein the socket comprises a clamping block which comprises an inclined guiding surface configured to guide the engaging member to be mounted to the socket.

2. The socket device of claim 1, wherein the sliding groove comprises an inner sidewall, a limiting slot is defined in the inner sidewall, and a limiting piece extending from the sliding piece is engaged in the limiting slot.

3. The socket device of claim 1, wherein the engaging member comprises a pressing portion, and the pressing portion is engaged with the clamping block to mount the engaging member to the socket.

4. The socket device of claim 3, wherein the socket further comprises a connecting portion and an engaging portion connected to the connecting portion, the sliding groove is defined in the engaging portion, the engaging portion comprises a mounting plate, and the sliding groove is located between the connecting portion and the mounting plate.

5. The socket device of claim 4, wherein the clamping block is located at a side of the mounting plate away from the sliding groove.

6. The socket device of claim 4, wherein the guiding surface extends slantedly to a top end of the mounting plate.

7. The socket device of claim 4, wherein the engaging member comprises the sliding piece, a base plate, and a connecting piece, and the sliding piece is connected to the base plate with the connecting piece; a receiving space is cooperatively defined by the sliding piece, the base plate, and the connecting piece; and the mounting plate is received in the receiving space.

8. The socket device of claim 7, wherein the pressing portion extends from the base plate, a notch is defined in the connecting piece, and the notch extends to the pressing portion.

9. The socket device of claim 1, wherein a thickness of the sliding piece is equal to a width of the sliding groove.

10. A socket device comprising:

a socket mounted on a circuit board and comprising a mounting plate, a clamping block extending from the mounting plate, and a sliding groove; and an engaging member movably mounted to the socket and comprising a pressing portion, a sliding piece slidably engaged in the sliding groove, a base plate, and a connecting piece, the connecting piece is perpendicularly connected to the base plate and the sliding piece, the pressing portion extends from the base plate, a receiving space is defined by the sliding piece, the base plate, and the connecting piece, and the mounting plate is configured to be received in the receiving space;

wherein the pressing portion is engagable with the clamping block to fix the engaging member to the socket.

11. The socket device of claim 10, wherein the socket comprises a connecting portion and an engaging portion connected to the connecting portion, the engaging portion comprises the mounting plate and defines the sliding groove, and the sliding groove is located between the connecting portion and the mounting plate.

12. The socket device of claim 10, wherein the connecting piece defines a notch extending to the pressing portion.

13. The socket device of claim 10, wherein the sliding groove comprises an inner sidewall, a limiting slot is defined in the inner sidewall, and a limiting extending from the sliding piece is configured to be engaged in the limiting slot.

14. A printed circuit board (PCB) assembly comprising:

a circuit board comprising a chip;

a socket mounted on the circuit board and defining a sliding groove; and an engaging member mounted to the socket and comprising a sliding piece engaged in the sliding groove;

wherein the sliding piece is slidable along the slot to detach the engaging member from the socket and the chip is below the engaging member.

15. The PCB assembly of claim 14, wherein the socket further comprises a clamping block, and engaging member further comprises a pressing portion engaged with the clamping block.

* * * * *